US007140504B1

(12) United States Patent
Baron

(10) Patent No.: US 7,140,504 B1
(45) Date of Patent: Nov. 28, 2006

(54) SEPARABLE TWO-COMPONENT DRINKING SYSTEM

(76) Inventor: Sharon Baron, 1105 Cardinal Creek Pl., Oviedo, FL (US) 32761

( * ) Notice: Subject to any disclaimer, the term of this patent is extended or adjusted under 35 U.S.C. 154(b) by 495 days.

(21) Appl. No.: 10/629,017

(22) Filed: Jul. 29, 2003

(51) Int. Cl.
*B65D 1/04* (2006.01)
*B65D 21/10* (2006.01)
*B65D 90/12* (2006.01)

(52) U.S. Cl. ..... 215/6; 215/10; 215/374

(58) Field of Classification Search ..... 215/10, 215/6, 503, 703, 374, 377, 393, 737, 756, 215/376, 399, 315, 395, 382, 380; 220/669, 220/4.01; D7/509
See application file for complete search history.

(56) References Cited

U.S. PATENT DOCUMENTS 131,141 A * 9/1872 Will ..... 215/377
598,891 A * 2/1898 Barnekov ..... 73/427
1,817,834 A * 8/1931 Orme ..... 431/292
1,957,263 A * 5/1934 Gray ..... 215/394
2,905,351 A * 9/1959 Lerner ..... 215/376
2,918,188 A * 12/1959 Todd ..... 215/377
2,996,208 A * 8/1961 Schroeder ..... 215/377
3,089,605 A * 5/1963 Buonauro ..... 215/377
3,526,335 A * 9/1970 Swett et al. ..... 220/630
4,124,207 A * 11/1978 Breslow et al. ..... 273/453
4,872,569 A * 10/1989 Bolte ..... 215/12.1
D486,693 S * 2/2004 Abramowski et al. ..... D7/527
D491,019 S * 6/2004 Marsden et al. ..... D7/523
2003/0098311 A1* 5/2003 Parentini ..... 220/630
2004/0134918 A1* 7/2004 Irwin ..... 220/630
2004/0134919 A1* 7/2004 Irwin et al. ..... 220/630

* cited by examiner

*Primary Examiner*—Jes F. Pascua
*Assistant Examiner*—Shawn M. Braden
(74) *Attorney, Agent, or Firm*—Edward P. Dutkiewicz

(57) ABSTRACT

A separable two-component drinking system comprising an upper component with a tapering side wall and a cylindrical lower axial extension, the side wall and the lower extension having a common central axis; and a lower component with a generally annular lateral extension and an upper aperture for the receipt of the axial extension during use, the lower component and the upper component sharing the same common central axis when coupled for use.

2 Claims, 8 Drawing Sheets

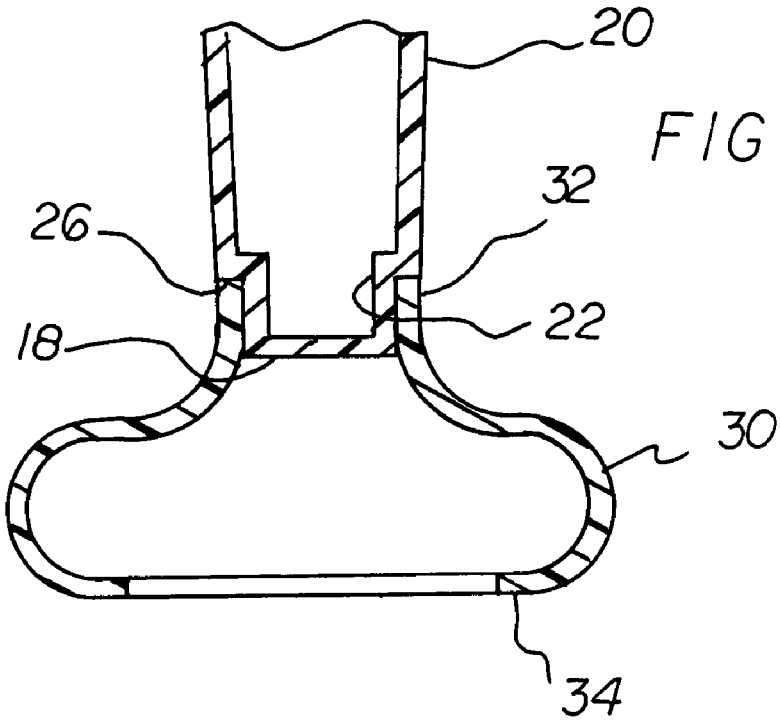
FIG 3
FIG 4
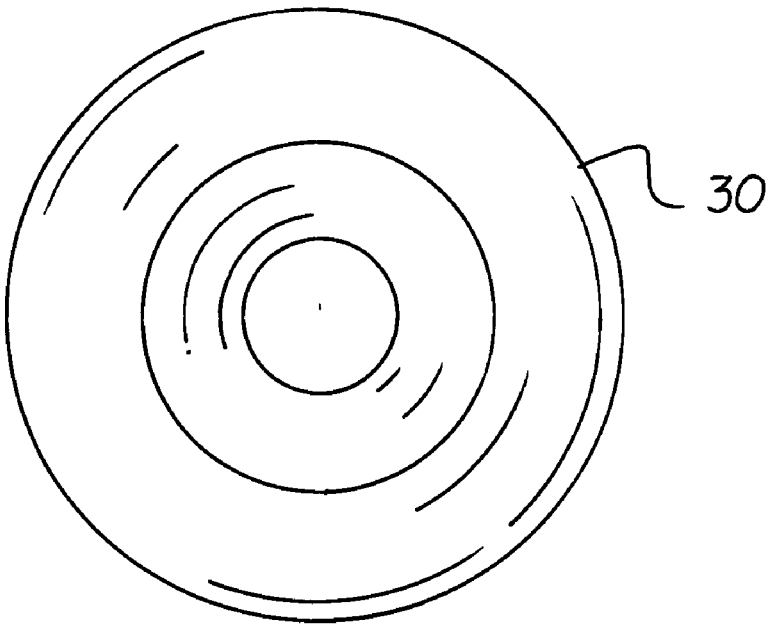

FIG 15
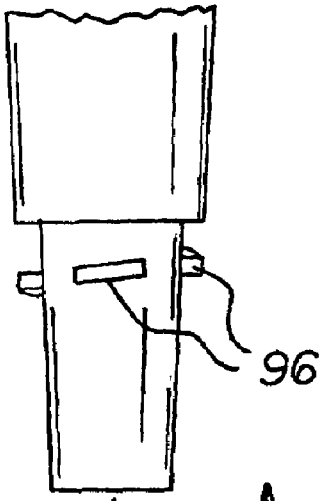
FIG 16
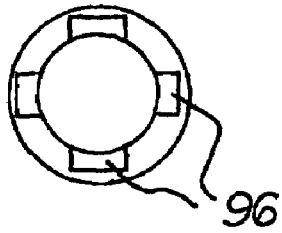
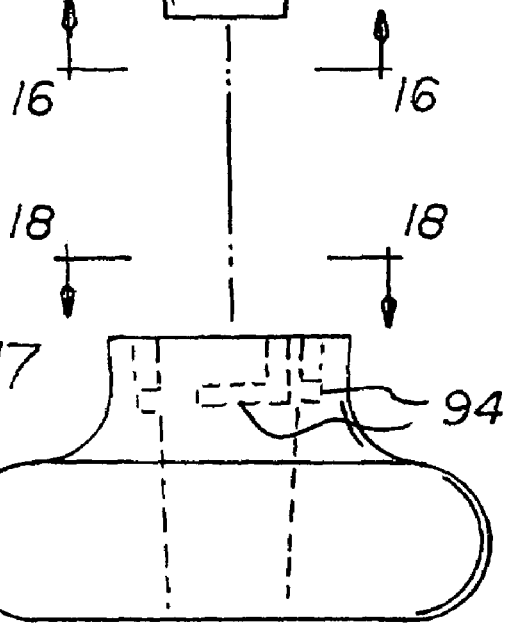
FIG 17
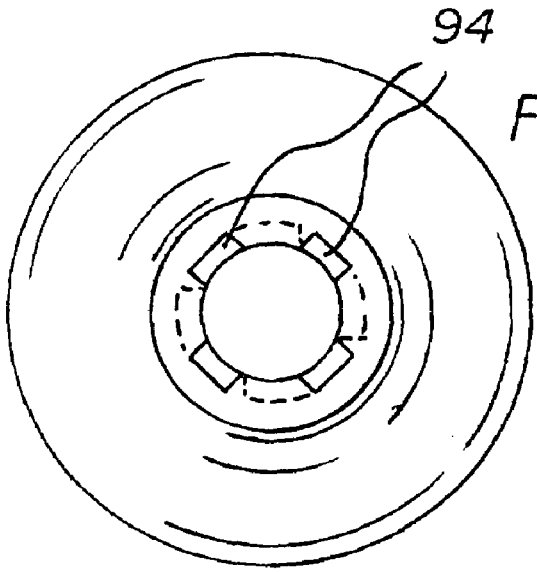
FIG 18

SEPARABLE TWO-COMPONENT DRINKING SYSTEM

BACKGROUND OF THE INVENTION

1. Field of the Invention

The present invention relates to a separable two-component drinking system and more particularly pertains to facilitating the separation, stacking and storing of pluralities of components of drinking vessels such as yards of ale.

2. Description of the Prior Art

The use of drinking vessels of known designs and configurations is known in the prior art. More specifically, drinking vessels of known designs and configurations previously devised and utilized for the purpose of stacking drinking vessels by conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,124,207 to Breslow discloses a game apparatus. In addition, U.S. Pat. No. 4,872,569 to Bolte discloses drinking vessels.

While these devices fulfill their respective, particular objectives and requirements, the aforementioned patents do not describe separable two-component drinking system that allows facilitating the separation, stacking and storing of pluralities of components of drinking vessels such as yards of ale.

In this respect, the separable two-component drinking system according to the present invention substantially departs from the conventional concepts and designs of the prior art, and in doing so provides an apparatus primarily developed for the purpose of facilitating the separation, stacking and storing of pluralities of components of drinking vessels such as yards of ale.

Therefore, it can be appreciated that there exists a continuing need for a new and improved separable two-component drinking system which can be used for facilitating the separation, stacking and storing of pluralities of components of drinking vessels such as yards of ale. In this regard, the present invention substantially fulfills this need.

SUMMARY OF THE INVENTION

In view of the foregoing disadvantages inherent in the known types of drinking vessels of known designs and configurations now present in the prior art, the present invention provides an improved separable two-component drinking system. As such, the general purpose of the present invention, which will be described subsequently in greater detail, is to provide a new and improved separable two-component drinking system and method which has all the advantages of the prior art and none of the disadvantages.

To attain this, the present invention essentially comprises a separable two-component drinking systems for facilitating the separation, stacking and storing of pluralities of components of drinking vessels such as yards of ale. The system comprises, in combination an upper component having an upper end and a lower end with an inwardly tapering side wall of continuously varying concavity there between. The upper component has a cylindrical lower axial extension at its lower end. The side wall and the lower extension have a common central axis. The side wall has a lower end with the lower extension joining to form a shoulder. The side wall has a continuous curve along its length with the upper end having a diameter greater than the lower end and with a tangent of the side wall being closer to perpendicular to the central axis the closer to the upper end and with a tangent of the side wall being closer to parallel to the central axis the closer to the lower end.

The system also includes a lower component having an upper end and a lower end with a generally annular lateral extension there between. The upper end of the lower component has an upper aperture with a diameter essentially equal to the diameter of the axial extension for the receipt of the axial extension during use. The lower end of the lower component has a lower aperture with a diameter greater than the diameter of the upper aperture. The upper aperture is adapted to receive the axial extension up to the shoulder. The system, including the lower component and the upper component, share the same common central axis when coupled for use.

The width of the system varies from about one fifth to one eighteenth of its height. The heights are measure axially along the length of the central axis.

A plurality of upper components are adapted to have their lower ends received within the upper ends of adjacent upper components one within another for stacking purposes as for storage and transportation. A plurality of lower components adapted to have their upper ends received within the lower ends of adjacent lower components one within another for stacking purposes as for storage and transportation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved separable two-component drinking system which has all of the advantages of the prior art drinking vessels of known designs and configurations and none of the disadvantages.

It is another object of the present invention to provide a new and improved separable two-component drinking system which may be easily and efficiently manufactured and marketed.

It is further object of the present invention to provide a new and improved separable two-component drinking system which is of durable and reliable constructions.

An even further object of the present invention is to provide a new and improved separable two-component drinking system which is susceptible of a low cost of manufacture with regard to both materials and labor, and which accordingly is then susceptible of low prices of sale to the consuming public, thereby making such separable two-component drinking system economically available to the buying public.

Even still another object of the present invention is to provide a separable two-component drinking system for facilitating the separation, stacking and storing of pluralities of components of drinking vessels such as yards of ale.

Lastly, it is an object of the present invention to provide a new and improved separable two-component drinking system comprising an upper component with a tapering side wall and a cylindrical lower axial extension, the side wall and the lower extension having a common central axis; and a lower component with a generally annular lateral extension and an upper aperture for the receipt of the axial extension during use, the lower component and the upper component sharing the same common central axis when coupled for use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view of the system taken along line 3—3 of FIG. 1.

FIG. 4 is a bottom view of the system taken along line 4—4 of FIG. 3.

FIGS. 15 through 18 illustrate a sixth embodiment of the invention featuring screw threads removably coupling the upper and lower components.

The same reference numerals refer to the same parts throughout the various Figures.

DESCRIPTION OF THE PREFERRED EMBODIMENT

Figure 1:
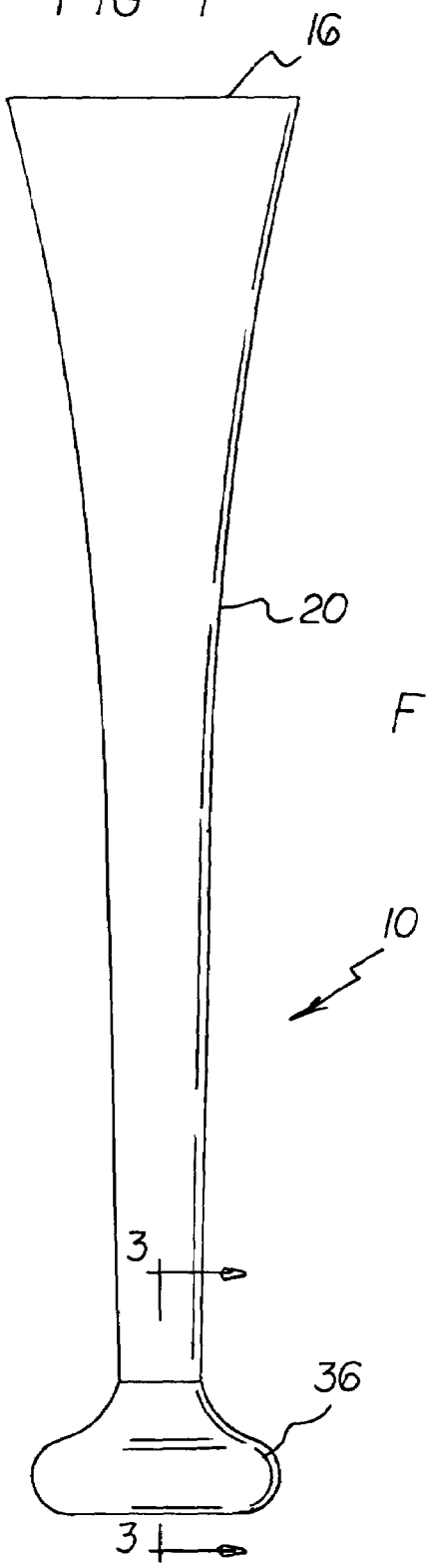
FIG. 1 is front elevational view of a two-component drinking system constructed in accordance with the principles of the present invention.
Figure 2:
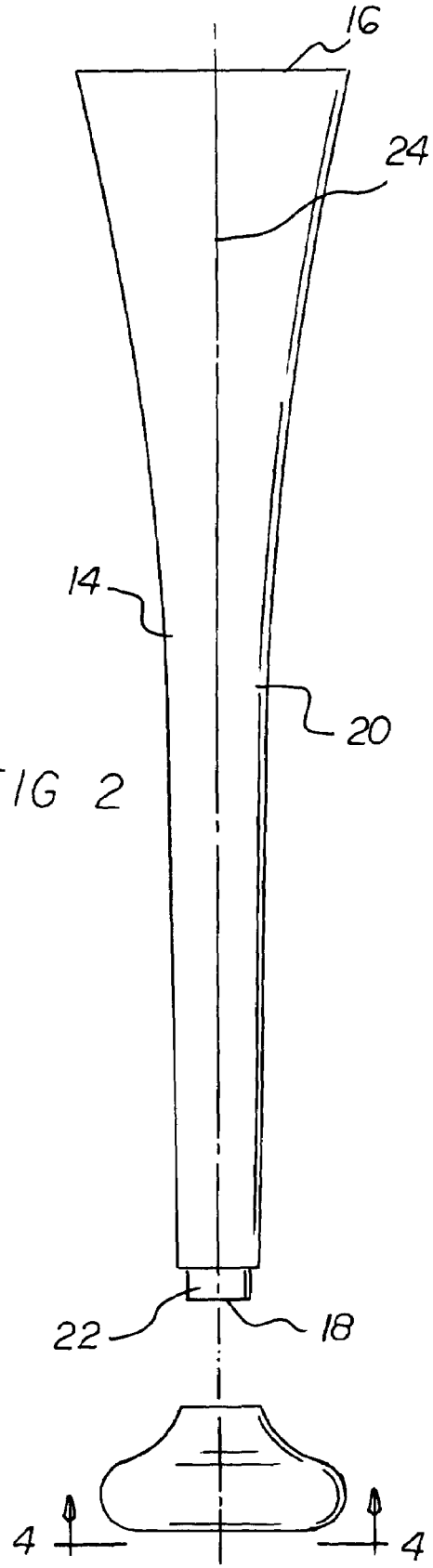
FIG. 2 is an exploded front elevational view of the two-component drinking system shown in FIG. 1.
Figure 5:
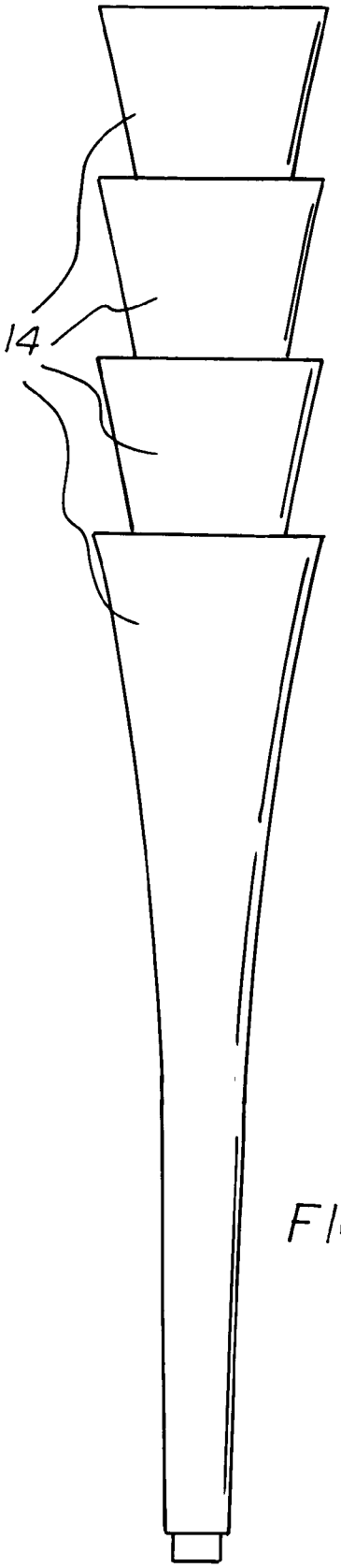
FIG. 5 is a side elevational view of a plurality of upper components in a stacked orientation for storage or transportation.
Figure 6:
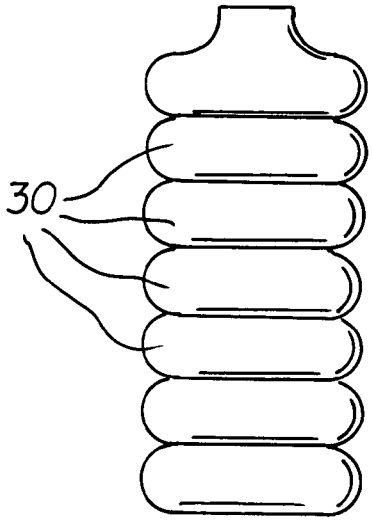
FIG. 6 is a side elevational view of a plurality of lower components in a stacked orientation for storage or transportation.

With reference now to the drawings, and in particular to FIG. 1 thereof, the preferred embodiment of the new and improved separable two-component drinking system embodying the principles and concepts of the present invention and generally designated by the reference numeral 10 will be described.

The present invention, the separable two-component drinking system 10 is comprised of a plurality of components. Such components in their broadest context include an upper component and a lower component. Such components are individually configured and correlated with respect to each other so as to attain the desired objective.

The system of the present invention is a separable two-component drinking systems 10 for facilitating the separation, stacking and storing of pluralities of components of drinking vessels such as yards of ale, The system comprises, in combination, an upper component 14 having an upper end 16 and a lower end 18 with an inwardly tapering side wall 20 of continuously varying concavity there between. The upper component has a cylindrical lower axial extension 22 at its lower end. The side wall and the lower extension have a common central axis 24. The side wall has a lower end with the lower extension joining to form a shoulder 26. The side wall has a continuous curve along its length. The upper end has a diameter greater than the lower end. A tangent of the side wall is closer to perpendicular to the central axis the closer to the upper end. A tangent of the side wall is closer to parallel to the central axis the closer to the lower end.

The system of the present invention also includes a lower component 30 having an upper end 32 and a lower end 34 with a generally annular lateral extension 36 there between. The upper end of the lower component has an upper aperture with a diameter essentially equal to the diameter of the axial extension for the receipt of the axial extension during use. The lower end of the lower component has a lower aperture with a diameter greater than the diameter of the upper aperture. The upper aperture is adapted to receive the axial extension up to the shoulder. The lower component and the upper component share the same common central axis when coupled for use. The width of the system varies from about one fifth to one eighteenth of its height. The heights are measure axially along the length of the central axis.

A plurality of upper components is adapted to have their lower ends received within the upper ends of adjacent upper, storage and transportation components one within another for stacking purposes as for storage and transportation. A plurality of lower components is adapted to have their upper ends received within the lower ends of adjacent lower components one within another for stacking purposes as for storage and transportation.

Figure 7:
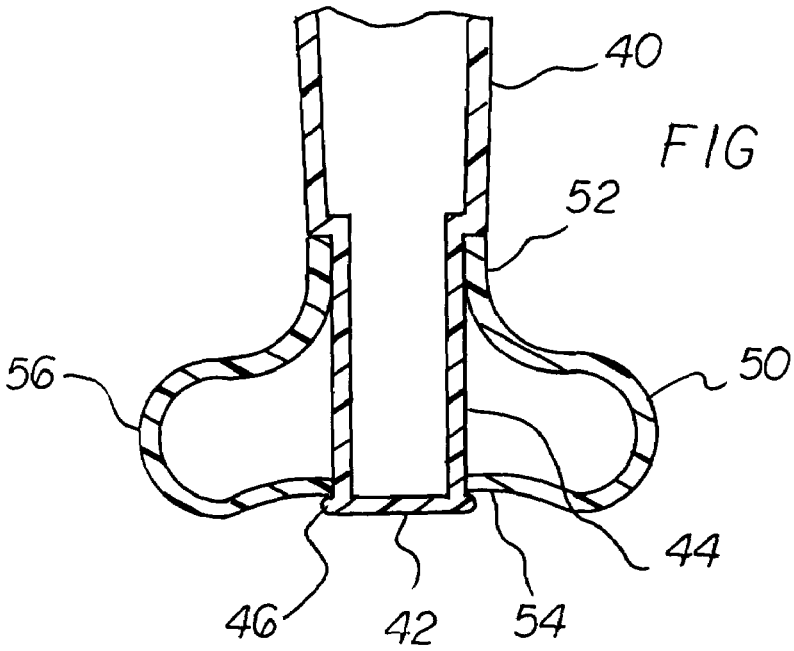
FIG. 7 is a cross sectional view similar to FIG. 3 but illustrating an alternate embodiment of the invention.
Figure 8:
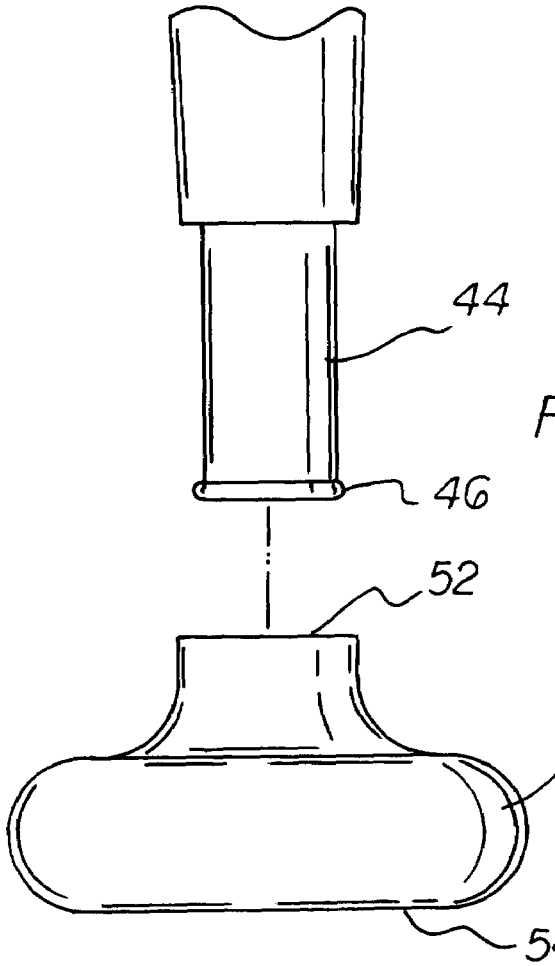
FIG. 8 is an exploded side elevational view of the components shown in FIG. 7.

An alternate embodiment of the invention is illustrated in FIGS. 7 and 8. In such embodiment, the upper component 40 has a lower end 42 with an axial extension 44. Such axial extension is of an extended length terminating in a rib 46 of a slightly larger diameter than the axial extension. Also included is the lower component 50. Such lower component has an upper end 52 with an upper aperture and a lower end 54 with a lower aperture and an annular lateral extension 56 there between. The apertures of the upper and lower ends are essentially equal for the receipt of the axial extension by the upper and lower apertures.

Figure 9:
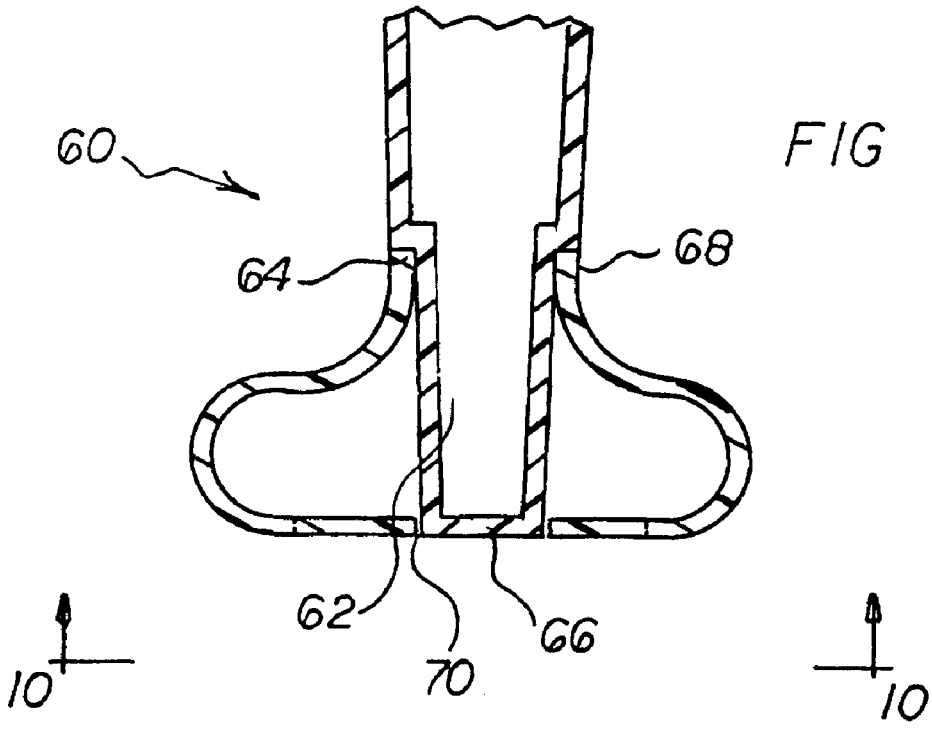
FIGS. 9 and 10 illustrate a third embodiment of the invention featuring a lower axial extension extending into an aperture in the bottom of the lower component.
Figure 10:
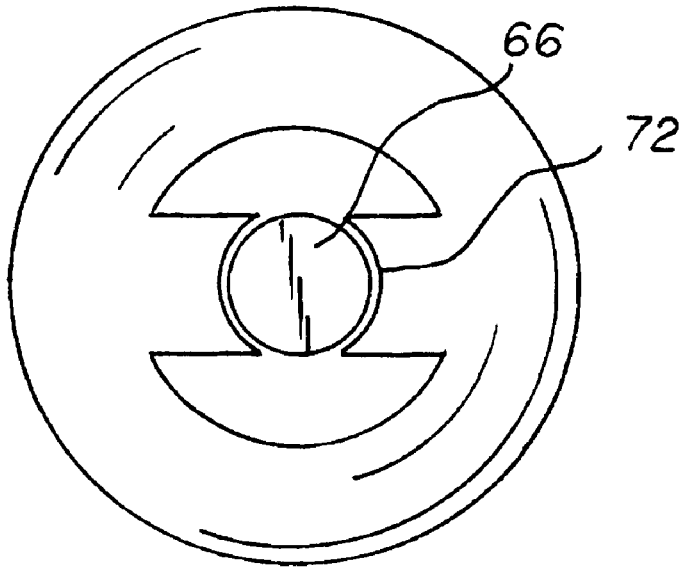

FIGS. 9 and 10 illustrate an alternate embodiment of the invention. In such embodiment 60, the upper component has a lower axial extension 62 of an extended length. A shoulder 64 is formed at the upper end of the extension to limit the coupling between the components. The lower end 66 of the extension extends to the lower extent of the lower component. The lower component 68 has a lower aperture 70 in the bottom for receiving the lower axial extension. In addition, the lower aperture is configured whereby only a portion 72 will contact only a portion of the circumference of the lower axial extension. Note FIG. 10.

Figure 11:
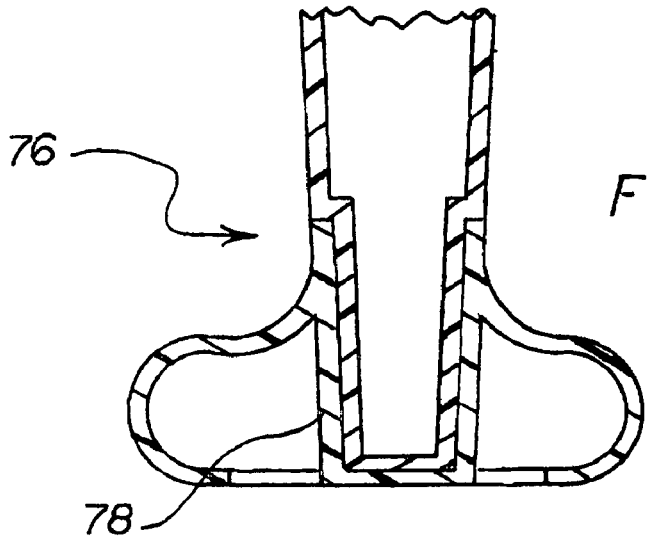
FIGS. 11 and 12 illustrate a fourth embodiment of the invention featuring a lower axial extension extending into a frustoconical pocket formed into the lower component.
Figure 12:
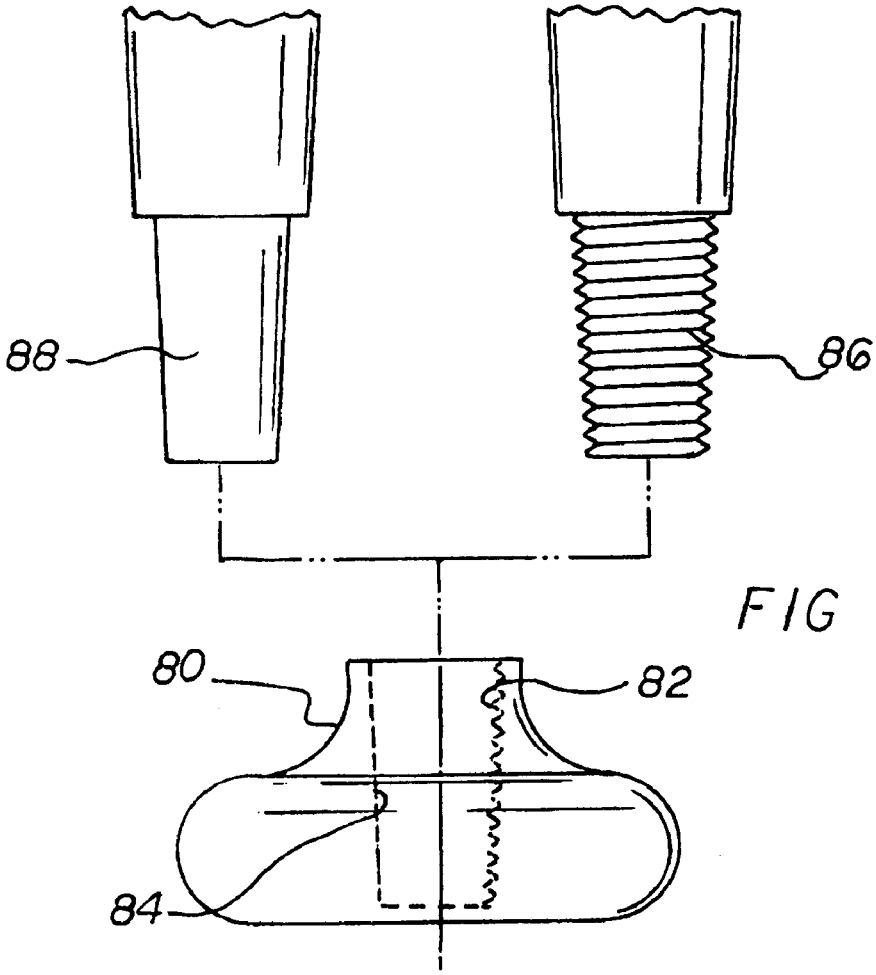

The embodiments 76 of FIGS. 11 and 12 feature a frustoconical lower axial extension 86, 88 of an extended length and the lower component 80 has a frustoconical pocket 78 for receiving the extension. In one embodiment, the extension 88 and the pocket 84 are smooth. In the other embodiment, the extension 86 and the pocket are formed with mating teeth 82.

Figure 13:
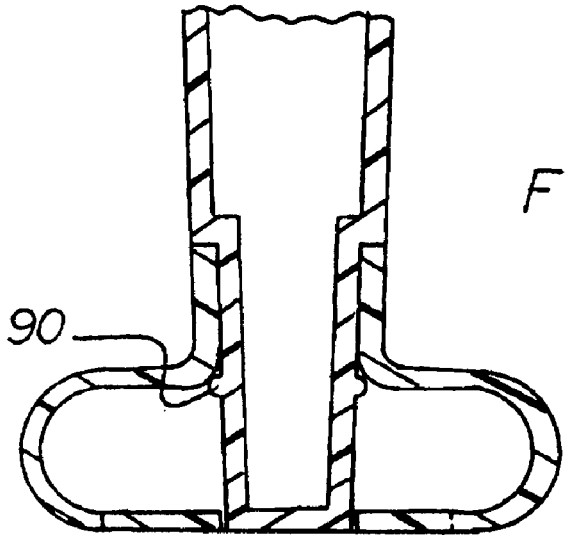
FIGS. 13 and 14 illustrate a fifth embodiment of the invention featuring an extended lower portion with a rib adapted to cooperate with the lower component.
Figure 14:
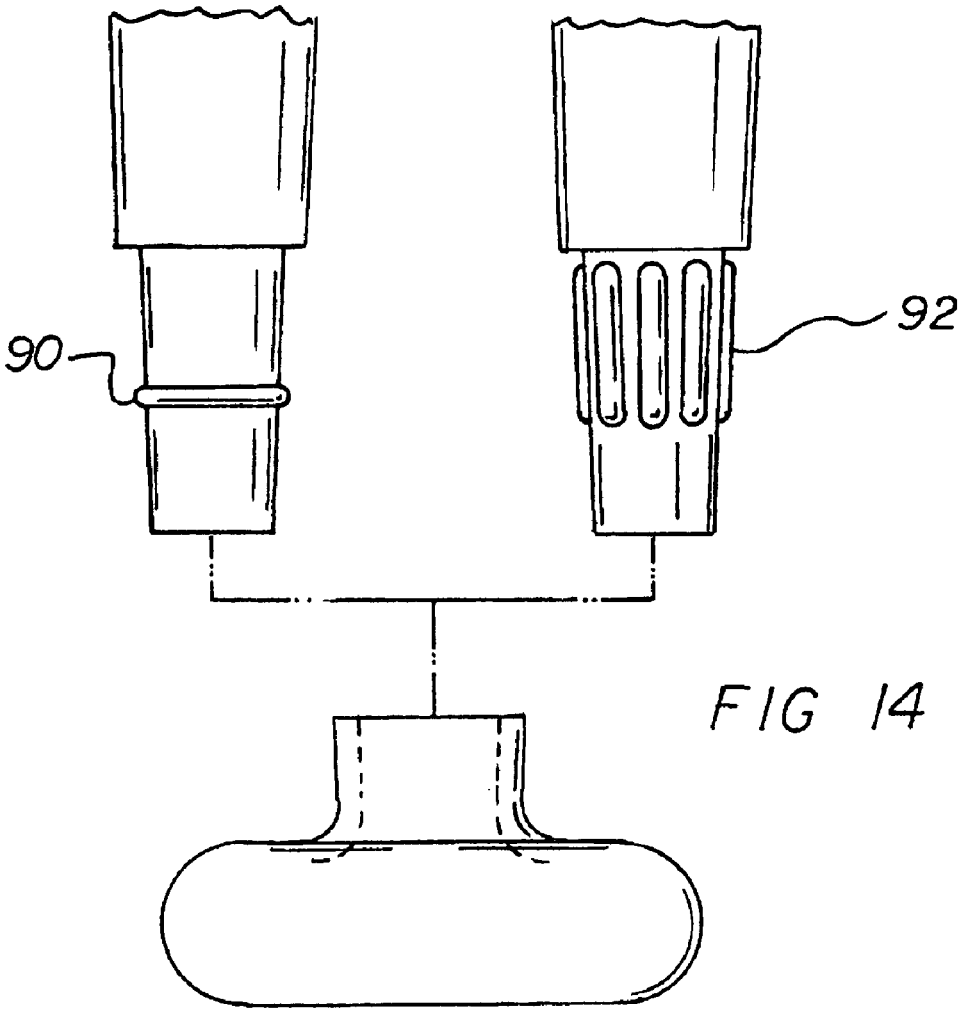

In other embodiments, the upper component has a lower axial extension of an extended length and the lower component has a lower aperture in the bottom for receiving the lower axial extension and the extension is formed with at least one outwardly extending rib 90, 92. In one embodiment, the rib 90 is circumferential. Note FIGS. 13 and 14. In another embodiment, the rib includes a plurality of essentially axially extending ribs 92. Note FIG. 14.

The final embodiment is illustrated in FIGS. 15 through 18. In such embodiment, the extension and the lower component are each formed with screw threads 94, 96 for removably coupling the upper component and lower component.

The upper and lower components of the various components may be made of the same or different materials or colors or designs. It is preferred that both components are transparent. They may be fabricated of glass or any suitable plastic.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Separable two-component drinking systems for facilitating the separation, stacking and storing of pluralities of components of drinking vessels including yards of ale comprising, in combination:

an upper component having an upper end and a lower end with an inwardly tapering concave side wall there between, the upper component having a cylindrical lower axial extension at its lower end, the upper component and the lower axial extension adapted to receive a drink for consumption by a user, the side wall and the lower extension having a common central axis, the side wall having a lower end with the lower extension joining to form a shoulder, the side wall having a continuous curve along its length with the upper end having a diameter greater than the lower end and with a tangent of the side wall being closer to perpendicular to the central axis the closer to the upper end and with a tangent of the side wall being closer to parallel to the central axis the closer to the lower end; and a lower component having an upper end and a lower end with a generally annular lateral extension there between, the upper end of the lower component having an upper aperture with a diameter essentially equal to the diameter of the axial extension for the receipt of the axial extension during use, the lower end of the lower component having a lower aperture with a diameter greater than the diameter of the upper aperture, the lower component having a passageway there through with the upper aperture forming a top of the passageway and the lower aperture forming a bottom of the aperture, the upper aperture adapted to receive the axial extension up to the shoulder, the system including the lower component and the upper component sharing the same common central axis when coupled for use, the width of the system varies from about one fifth to one eighteenth of its height, the heights being measure axially along the length of the central axis, and a plurality of upper components adapted to have their lower ends received within the upper ends of adjacent upper components one within another for stacking purposes as for storage and transportation and a plurality of lower components adapted to have their upper ends received within the lower ends of adjacent lower components one within another for stacking storage and transportation.

2. A separable two-component drinking system comprising:

an upper component with a tapering side wall and a cylindrical lower axial extension, the side wall and the lower extension having a common central axis; and a lower component with a generally annular lateral extension and an upper aperture for the receipt of the axial extension during use, the lower component and the upper component sharing the same common central axis when coupled for use, the upper component having a lower axial extension of an extended length and the lower component having a lower aperture in the bottom for receiving the lower axial extension and the lower aperture being configured to contact only a portion of the circumference of the lower axial extension.

* * * * *